United States Patent [19]

Yokota et al.

[11] 3,959,843

[45] June 1, 1976

[54] APPARATUS FOR EXTRACTING LIQUID FROM CLOTH IN ROPE FORM

[75] Inventors: Rikizo Yokota, Kyoto, Japan

[73] Assignee: Uenoyama Kiko Co., Ltd., Kyoto, Japan

[22] Filed: Oct. 10, 1974

[21] Appl. No.: 513,560

[30] Foreign Application Priority Data

Oct. 10, 1974 Japan ..... 49-117526

[52] U.S. Cl. ..... 15/306 A; 34/157

[51] Int. Cl.[2] ..... A47L 5/38

[58] Field of Search ..... 34/153, 92, 157; 15/306 A, 306 R

[56] References Cited

UNITED STATES PATENTS

| | | | |
|---|---|---|---|
| 1,629,154 | 5/1927 | Ybarrondo | 15/306 A |
| 2,784,652 | 3/1957 | Hornbostel | 15/306 A X |
| 2,871,502 | 2/1959 | Whisnant | 15/306 A |
| 3,771,236 | 11/1973 | Canoor | 34/92 X |

FOREIGN PATENTS OR APPLICATIONS

| | | | |
|---|---|---|---|
| 6,616,457 | 2/1967 | Netherlands | 15/306 A |
| 843,806 | 8/1960 | United Kingdom | 15/306 A |

*Primary Examiner*—Kenneth W. Sprague
*Assistant Examiner*—Harold Joyce
*Attorney, Agent, or Firm*—Amster & Rothstein

[57] ABSTRACT

An apparatus for extracting a liquid from cloth in rope form including a rotary roller having a V- or U-shaped groove for guiding cloth in rope form, and a fixed hollow shaft or cylinder for rotatably supporting said rotary roller thereon. The rotary roller is provided with a number of small apertures radially extending through and distributed over the entire bottom of the groove, while the hollow shaft or cylinder has an opening at a position on the circumference thereof opposed to the small apertures of the rotary roller. The hollow shaft or cylinder is connected to a vaccum pump so that a vacuum suction force directed towards the axis of the rotary roller may be exerted on cloth in the groove through the opening and apertures.

5 Claims, 3 Drawing Figures

APPARATUS FOR EXTRACTING LIQUID FROM CLOTH IN ROPE FORM

BACKGROUND OF THE INVENTION

The present invention relates to a hydroextracting apparatus for cloth, and more particularly to an apparatus for extracting most of the liquid content from cloth which is in rope form and has been treated with any desired solution such as washing water, dye solution or the like and has a substantial amount of liquid content adsorbed thereon.

As is known in the art, such extraction of liquids from cloth in rope form has been carried out mostly either by a system in which cloth is pressed by a rubber roll to extract the liquid content (padder system) or by a system in which cloth is put in a rotary tank to centrifugally extract the liquid content (centrifugal hydroextraction). The two systems, though differing in form from each other, are based on the application of a strong compressive force to cloth in rope form for a relatively long period of time. Consequently, this results in wrinkles which are difficult to remove. Further, with the former system, since tension is applied, there is the disadvantage that both warp and weft are distorted (lenghwise, expanded and widthwise contracted). With the latter system, since the treatment is batchwise, there is the disadvantage that the efficiency is very low.

SUMMARY OF THE INVENTION

Accordingly, a principal object of the present invention is to provide an apparatus capable of continuously extracting liquids from cloth without a strong compressive force extending over a long time or a tension tending to cause the distortion of both warp and weft.

Another object of the invention is to provide an apparatus for extracting liquids from cloth, which achieves the above-mentioned object and is simple in construction and easy to manufacture.

In brief, in order to achieve the foregoing objects the present invention provides an apparatus for extracting a liquid from cloth in rope form by making use of vacuum suction force, comprising a rotary roller having a groove adapted to receive and guide cloth in rope form which has been treated with any desired solution and has said liquid content adsorbed thereon, and a number of small apertures formed in and radially extending through the bottom portion of said groove around the entire circumference thereof, a fixed hollow shaft or cylinder supporting said rotary roller for rotation thereon and having an opening at a position on the circumference thereof opposed to the small apertures of the rotary roller, and a vacuum pump connected to said hollow shaft or cylinder, whereby a vacuum suction force directed toward the axis of the rotary roller is exerted on the cloth in the groove to extract the liquid content therefrom.

The groove of the rotary roller may preferably be substantially V- or U-shaped in cross-section. Further, the hollow shaft or cylinder has sealing means attached to the outer surface thereof, especially at least the marginal portion of the opening so that the opening may communicate only with the small apertures of the rotary roller.

It is desirable that the size of the opening provided in the hollow shaft or cylinder and the size of the small apertures formed in the rotary roller be such that the ratio of the total area of the small apertures belonging to or covered by the opening to the area of the opening is about 0.4 or less or that the rate of suction flow through the small apertures in operation is about 50 – 350 m/sec.

An embodiment of the apparatus of the present invention will now be described with reference to the accompanying drawing.

DETAILED DESCRIPTION OF THE PREFERRED EMBODIMENT OF THE INVENTION

Figure 1:
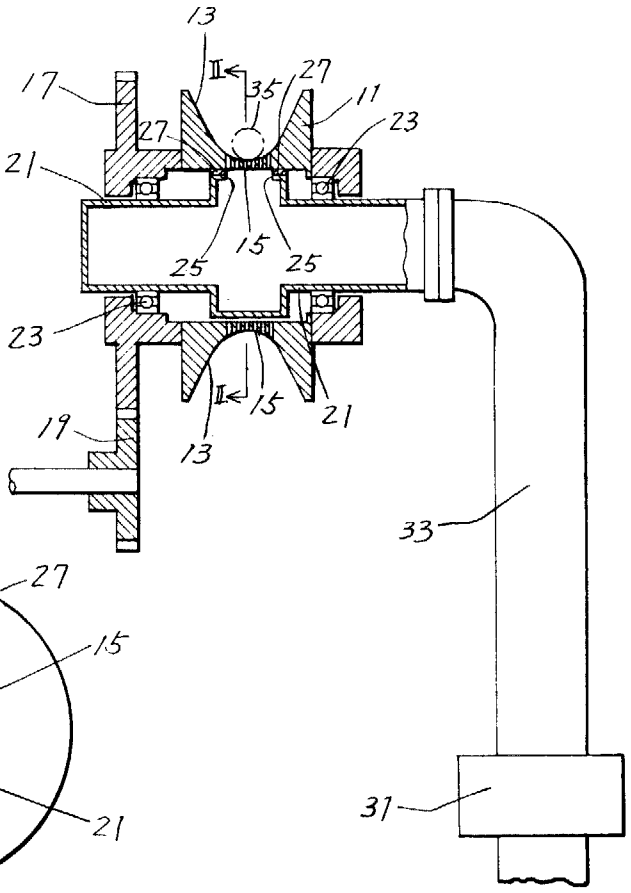
FIG. 1 is a longitudinal section of the principal portions of an embodiment of the liquid extracting apparatus of the present invention.
Figure 2:
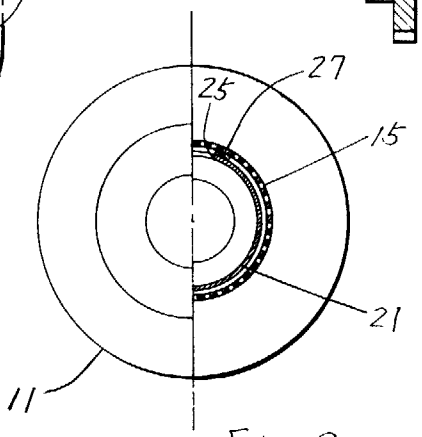
FIG. 2 is a cross-section taken along the line II—II of FIG. 1.

FIGS. 1 and 2 illustrate an embodiment of the liquid extracting apparatus of the present invention. The illustrated apparatus basically comprises a rotary roller 11 substantially in the form of a V-pulley, a hollow shaft or cylinder 21 supporting the rotary roller for rotation thereon, and a vacuum pump 31 connected to the hollow shaft. The rotary roller 11 is provided with a groove 13 substantially V- or U-shaped in cross-section adapted to engage and guide cloth 35 in rope form, and a number of small apertures 15 distributed over the entire circumference of the bottom of the groove and radially extending therethrough. The size and spacing of the small apertures, of course, depend upon the conditions of hydroextraction treatment including the size and rotative speed of the rotary roller. As an example, the diameter of the small apertures may be 1 – 5 mm and the distance between adjacent apertures may 3 – 5 mm. The rotary roller 11 has a gear wheel 17 concentric therewith which is integrally secured to the side of the rotary roller. This gear wheel 17 engages a driving gear wheel 19 connected to a motor or other suitable drive source (not shown) so as to drive the rotary roller in rotation.

The hollow shaft 21, which supports the rotary roller 11 for rotation thereon through bearings 23, is provided with an opening 25 at a position on the circumference thereof opposed to the groove 13 of the rotary roller, for example, in the lower or upper portion of the hollow shaft, so that as the rotary roller is rotated, all the small apertures 15 formed therein successively communicate with the opening 25. The size of the opening 25 should naturally vary according to the conditions of hydroextraction treatment, but it has been found desirable that preferably the size is such that the ratio of the total area of the small apertures belonging to or covered by the opening to the area of the opening (porosity) is about 0.4 (40%) or less, or that the rate of suction air flow through the small apertures in operation is about 50 – 350 m/sec.

The outer surface of the hollow shaft 21, especially at least the marginal portion of the opening 15 in the hollow shaft 21 has sealing means 27 adhesively secured thereto, as shown, to seal the clearance between the marginal portion of the opening and the inner surface of the groove of the rotary roller so that the opening communicates only with the small apertures. The sealing means may be formed, for example, of carbon, Teflon resin or phenol resin.

One end of the hollow shaft 21 is closed while the other end is connected through a pipe 33 to a vacuum pump 31 driven by a motor (not shown). The vacuum pump may, for example, be a NASH type water-sealed vacuum pump generally used for such hydroextraction.

When the vacuum pump 31 is operated, a vacuum suction force with a high rate of suction flow is created in the small apertures 15 in the groove of the rotary roller 11 at a position opposed to the opening 25 in the hollow shaft 21. As a result, as the rotary roller is rotated, cloth 35 in rope form introduced into the groove of the rotary roller 11 is successively pulled by said vacuum suction force at a position opposed to the opening 25 in the hollow shaft 21 and is urged (or pressed) against the bottom of the groove 13 and, while being subjected to a strong hydroextraction force, it is transferred along with the rotation of the rotary roller 11.

With this liquid extracting apparatus, since the size of the small apertures 15 is small, a strong vacuum force with a high rate of suction flow is exerted to carry out instanteneous hydroextraction, so that there is no danger of wrinkles being created. Moreover, since the transfer of the cloth 35 is carried out along with the rotation of the rotary roller 11 while it is being urged against the rotary roller by the vacuum suction force, no tension acts on the cloth, so that the disadvantage of both warp and weft being distorted is eliminated.

Figure 3:
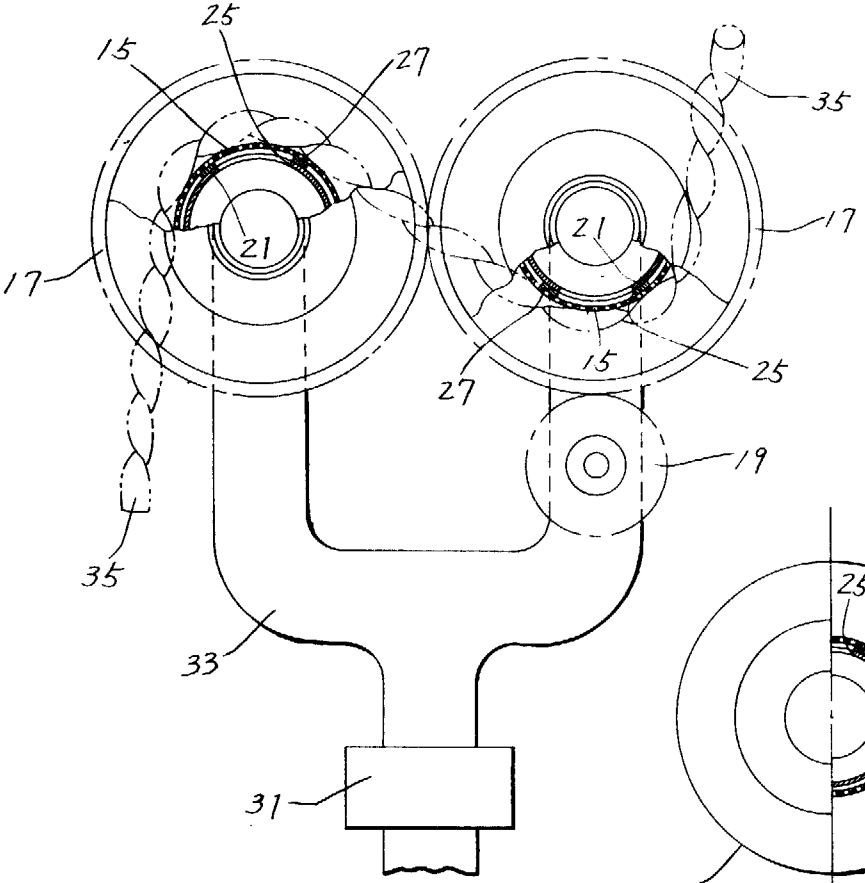
FIG. 3 shows a practical example of the use of the apparatus of the invention.

FIG. 3 illustrates a practical example of the use of the hydroextracting apparatus of the present invetnion. In this arrangement, two liquid extracting or hydroextracting means, each of which consists of a hollow shaft and a rotary roller forming the principal portions of the liquid extracting apparatus, are arranged side by side with their gear wheels 17, 17 engaging each other and with the openings in their respective hollow shafts shifted 180° apart from each other, the one above and the other below. With the two hydroextracting means arranged in the manner described above, cloth 35 in rope form can be guided so as to be subjected to hydroextracting actions in different directions (from above and below), thereby making more efficient hydroextraction treatment possible. The number of hydroextracting means arranged with the positions of the openings in the hollow shafts shifted from each other is not limited to two as shown but any suitable number may, of course, be selected.

What is claimed is:

1. An apparatus for extracting liquid from cloth in rope form comprising a rotary roller including a groove therein for receiving and guiding the rope form cloth which has liquid content absorbed therein and a predetermined maximum providing a first predetermined curvature;

said groove formed with an arcuate central inner section and two connected side sections, each side section connected respectively on opposite sides of said central section and extending outwardly and radially therefrom to provide a generally U-shape for said groove;

said arcuate section having a second predetermined curvature considerably larger than said first predetermined curvature of the rope form cloth to provide substantial spacing between each of said side sections and the rope form cloth;

said arcuate section having a plurality of small apertures radially extending therethrough around the entire circumference of said arcuate section;

a fixed hollow shaft having one end closed and the other end connected to a vacuum pump for applying a suction force to said shaft;

said shaft including an opening formed in a portion of its surface; and said roller mounted for rotation on said shaft in a location thereon providing for said plurality of apertures to pass over said opening during each revolution of said rotary roller whereby the liquid content of said rope form cloth is extracted therefrom.

2. An apparatus according to claim 1 in which the ratio of the total area of the small apertures of the rotary roller included in the opening in the hollow shaft or cylinder to the area of said opening is 0.4 or less.

3. An apparatus according to claim 1 in which the rate of suction air flow through the small apertures of the rotary roller is about 50 – 350 m/sec.

4. An apparatus according to claim 1 in which the diameter of said small apertures is within the range of 1–5 mm., and the distance between adjacent apertures is within the range of 3–5 mm.

5. An apparatus for extracting liquid from cloth in rope form comprising two rotary rollers mounted respectively in longitudinal alignment on spaced fixed parallel shafts;

each roller including a groove therein for receiving and guiding the rope form cloth which has liquid content absorbed therein and a predetermined maximum diameter providing a first predetermined curvature;

each said groove formed with an arcuate central inner section and two connected side sections, each side section connected respectively on opposite sides of said central section and extending outwardly and radially therefrom to provide a generally U-shape for said groove;

each said arcuate section having a second predetermined curvature considerably larger than said first predetermined curvature of the rope form cloth to provide substantial spacing between each of said side sections and the rope form cloth;

each said arcuate section having a plurality of small apertures radially extending therethrough around the entire circumference of said arcuate section;

each said hollow shaft having one end closed and the other end connected to a vacuum pump for applying a suction force to each said shaft;

each said shaft including an opening formed in a portion of its surface, said openings being shifted 180° with respect to each other; and each said roller mounted for rotation on its respective shaft in a location thereon providing for each said plurality of apertures to pass over its respective said opening during each revolution of each said rotary roller whereby the liquid content is extracted therefrom in different directions through said openings.

* * * * *